United States Patent [19]

Chen et al.

[11] Patent Number: 5,036,258

[45] Date of Patent: Jul. 30, 1991

[54] COLOR CRT SYSTEM AND PROCESS WITH DYNAMIC QUADRUPOLE LENS STRUCTURE

[75] Inventors: Hsing-Yao Chen, Barrington; Richard M. Gorski, Glenview, both of Ill.

[73] Assignee: Zenith Electronics Corporation, Glenview, Ill.

[21] Appl. No.: 392,630

[22] Filed: Aug. 11, 1989

[51] Int. Cl.[5] ..... H01J 29/58

[52] U.S. Cl. ..... 315/382; 313/414; 315/15

[58] Field of Search ..... 315/14, 15, 382, 382.1; 313/414, 449

[56] References Cited

U.S. PATENT DOCUMENTS

| | | | |
|---|---|---|---|
| 2,801,363 | 7/1957 | Sonnenfeldt . | |
| 2,957,106 | 10/1960 | Moodey . | |
| 3,412,281 | 11/1968 | Richards, Jr. et al. . | |
| 3,448,316 | 6/1969 | Yoshida et al. . | |
| 3,513,222 | 4/1985 | Chen . | |
| 3,772,554 | 11/1973 | Hughes . | |
| 3,952,224 | 4/1976 | Evans, Jr., deceased . | |
| 3,995,194 | 11/1976 | Blacker, Jr. et al. . | |
| 4,058,753 | 11/1977 | Blacker et al. . | |
| 4,234,814 | 11/1980 | Chen et al. . | |
| 4,242,613 | 12/1980 | Brambring et al. . | |
| 4,249,112 | 2/1981 | McKibben | 315/382 |
| 4,319,163 | 3/1982 | Chen . | |
| 4,334,169 | 6/1982 | Takenaka et al. . | |
| 4,366,414 | 12/1982 | Hatayama et al. . | |
| 4,473,775 | 9/1984 | Hosokoshi et al. . | |
| 4,520,292 | 5/1985 | van Hekken et al. . | |
| 4,523,123 | 6/1985 | Chen . | |
| 4,629,933 | 12/1986 | Bijma et al. . | |
| 4,641,058 | 2/1987 | Kosahigoe et al. . | |
| 4,701,677 | 10/1987 | Ashizaki et al. | 315/382 |
| 4,704,565 | 11/1987 | Blacker, Jr. et al. . | |
| 4,742,279 | 5/1988 | Gerritsen et al. | 313/414 |
| 4,771,216 | 9/1988 | Blacker et al. . | |
| 4,772,827 | 9/1988 | Osakabe | 315/382 |
| 4,814,670 | 3/1989 | Suzuki et al. | 315/15 |
| 4,825,120 | 4/1989 | Takahashi . | |
| 4,851,741 | 7/1989 | Shirai et al. | 315/382 |
| 4,877,998 | 10/1989 | Maninger et al. | 315/15 |
| 4,886,999 | 12/1989 | Yamane et al. | 313/414 |
| 4,935,663 | 6/1990 | Shimoma et al. | 313/414 |

FOREIGN PATENT DOCUMENTS

0178857A2 4/1986 European Pat. Off. .

OTHER PUBLICATIONS

Bloom et al, "Interdigital Grids for Dynamic Astigmatism Control in Picture-Tube Guns" IEE Transactions on Electron Devices, vol. 36, No. 4, Apr. 1989, pp. 777-784.

(List continued on next page.)

*Primary Examiner*—Theodore M. Blum

[57] ABSTRACT

For use in a color cathode ray tube (CRT) having a self-converging yoke for applying an asymmetric magnetic field in a synchronous manner to a plurality of inline electron beams for deflecting the electron beams across a phosphorescing screen in the CRT, wherein the magnetic field causes defocusing of and an astigmatism of the electron beams where incident upon the CRT screen in off-center regions of the screen, an electron gun comprising: a cathode for generating electrons; a beam crossover arrangement for receiving electrons from the cathode and for forming a beam crossover; a first electrostatic quadrupole field aligned in a spaced manner along the electron beams and having a first asymmetric aperture through which the inline electron beams pass for applying a first electrostatic quadrupole field to the electron beams in compensating for the defocusing and astigmatism of the electron beams; and a second electrostatic quadrupole field aligned in a spaced manner along the electron beams with the first electrostatic quadrupole field and having a second asymmetric aperture through which the inline electron beams pass for applying a second electrostatic quandrupole field to the electron beams for further compensating for the defocusing and astigmatism of the electron beams.

3 Claims, 4 Drawing Sheets

OTHER PUBLICATIONS

Article from SID 87 Digest, pp. 162–165, entitled "Quadrupole Lens for Dynamic Focus and Astigmatism Control in an Elliptical Aperture Lens Gun", of Hitachi, Ltd., Kokubunji, Tokyo, Japan.

Article from SID 87 Digest, pp. 166–169, entitled "Progressive-Scanned 33-in, 110° Flat-Square Color CRT", of Matsushita Electronics Corporation, Osaka, Japan.

Article from SID 88 Digest, pp. 136–139, entitled "Dynamic Astigmatism Control Quadra Potential Focus Gun for 21-in, Flat Color Display Tube"of Toshiba Corporation, Fukaya, Saitama, Japan.

Article from Japan Display-86, pp. 44–47, entitled "In-Line Gun with Dynamic Astigmatism and Focus Correction", of Matsushita Electronics Corporation Takatsuki, Osaka, Japan.

Article from Japan Display '86, pp. 160–163, entitled "An In-Line Color CRT with Dynamic Beam Shaping for Data Display", of Mitsubishi Electric Corporation, CRT Factory, Kyoto Works, Nagaokakyo, Kyoto, Japan.

Article from Proceedings of the Society for Information Display, vol. 23, No. 3, 1982, pp. 123–127, of H. Y. Chen, entitled "An In-Line Gun for High-Resolution Color Display", of RCA Picture Tube Division, Lancaster, Pa.

NEGATIVE ASTIGMATISM CORRECTION

POSITIVE ASTIGMATISM CORRECTION

BIPOTENTIAL TYPE ML DESIGN

EINZEL TYPE ML DESIGN

QPF TYPE ML DESIGN

BU TYPE ML DESIGN

COLOR CRT SYSTEM AND PROCESS WITH DYNAMIC QUADRUPOLE LENS STRUCTURE

BACKGROUND OF THE INVENTION

This invention relates generally to color cathode ray tubes (CRTS) and is particularly directed to the control of multiple electron beams incident upon the faceplate of a color CRT.

Most color CRTs employ an inline electron gun arrangement for directing a plurality of electron beams on the phosphorescing inner screen of its glass faceplate. The inline electron gun approach offers various advantages over earlier "delta" electron gun arrangements particularly in simplifying the electron beam positioning control system as well as essentially eliminating the tendency of the electron beams to drift. However, inline color CRT's employ a self-converging deflection yoke which applies a nonuniform magnetic field to the electron beams, resulting in an undesirable astigmatism in and defocusing of the electron beam spot displayed on the CRT's faceplate. In order to achieve three electron beam convergence at the screen edges and corners, the self-converging yoke applies a dynamic quadrupole magnetic field to the beams which over-focuses the beams in the vertical direction and under-focus them in the horizontal direction. This is an inherent operating characteristic of the inline yoke design.

One approach to eliminate this astigmatism and deflection defocus employs a quadrupole lens with the CRT's focusing electrode which is oriented 90° from the sel-fconverging yoke's quadrupole field. A dynamic voltage, synchronized with electron beam deflection, is applied to the quadrupole lens to compensate for the astigmatism caused by the deflection system. This dynamic voltage also allows for dynamic focusing of the electron beams over the entire CRT screen. The astigmatism of the electron beam caused by the quadrupole lens tends to offset the astigmatism caused by the color CRT's self-converging deflection yoke and generally improves the performance of the CRT.

An article entitled "Progressive-Scanned 33-in. 110° Flat-Square Color CRT" by Suzuki et al published in SID 87 Digest, at page 166, discloses a dynamic astigmatism and focus (DAF) gun wherein spot astigmatism and deflection defocusing are simultaneously corrected using a single dynamic voltage. The electron gun employs a quadrupole lens to which the dynamic voltage is applied and which includes a plurality of generally vertically elongated apertures in a first section of a focusing electrode and a second pair of aligned, generally horizontally oriented elongated apertures in a second section of the focusing electrode. Each electron beam first transits a vertically aligned aperture, followed by passage through a generally horizontally aligned aperture in the single quadrupole lens for applying astigmatism correction to the electron beam.

An article entitled "Quadrupole Lens For Dynamic Focus and Astigmatism Control in an Eliptical Aperture Lens Gun" by Shirai et al, also published in SID 87 Digest, at page 162, discloses a quadrupole lens arrangement comprised of three closely spaced electrodes, where the center electrode is provided with a plurality of keyhole apertures and the outer electrodes are provided with a plurality of square recesses each with a circular aperture in alignment with each of the respective electron beams. A dynamic voltage $V_d$ is applied to the first and third electrodes so as to form a quadrupole field to compensate for the astigmatism caused by the self converging yoke deflection system. Although this allows for a reduction in the dynamic voltage applied to the quadrupole, this voltage still exceeds 1 KV in this approach. While these two articles describe improved approaches for beam focusing and astigmatism compensation, they too suffer from performance limitations particularly in the case of those CRTs having a flat faceplate and foil tension shadow mask, where the flat geometry imposes substantially greater challenges than those encountered with a curved faceplate.

The present invention represents an improvement over the various aforementioned prior art approaches by providing a dynamic quadrupole lens for an inline color CRT which applies a sweep-synchronized dynamic quadrupole field to the electron beams to compensate for the astigmatism caused by the beam deflection yoke. The quadrupole field is uniquely defined by the shape of the aligned apertures in the spaced, charged electrodes of the lens as well as by the relative polarity of adjacent electrodes to provide the electron beam convergence or divergence required for beam astigmatism compensation and multi-beam focusing correction.

OBJECTS OF THE INVENTION

Accordingly, it is an object of the present invention to provide an improved lens in a CRT for focusing an electron beam.

It is another object of the present invention to dynamically compensate for astigmatism and beam focusing errors in an inline, multi-beam color CRT.

Yet another object of the present invention is to provide a quadrupole lens adapted for use in virtually any of the more common inline color CRTs.

A further object of the present invention is to provide a dynamic quadrupole lens having a plurality of spaced, multi-apertured charged electrodes for use in an inline color CRT which affords precise control of electron beam convergence/divergence by means of quadrupole polarity selection and electrode aperture orientation.

A still further object of the present invention is to provide an improved electron gun for a color CRT, particularly a color CRT having a planar tension mask and a flat faceplate.

Another object of the present invention is to compensate for the non-uniform magnetic field of a self-converging deflection yoke in a color CRT by dynamically controlling horizontal and vertical divergence/convergence of the CRT electron beams.

A further object of the present invention is to provide improved control over electron beam convergence and divergence in a quadupole electron beam lens for an inline color CRT.

A still further object of the present invention is to allow for a reduction in the dynamic focusing voltage provided to a quadrupole electron beam focusing lens for a color CRT and minimize problems involving additional high voltage application through a CRT neck pin.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
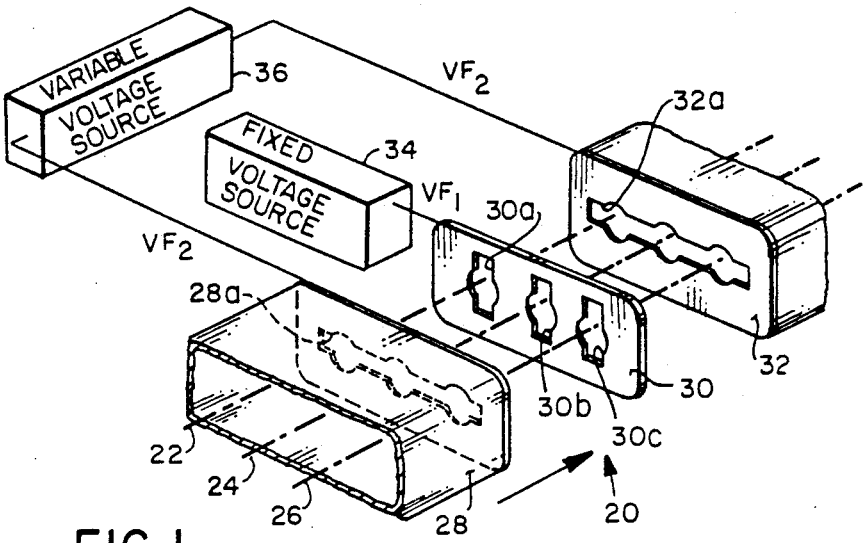
FIG. 1 is a perspective view of a dynamic quadrupole lens for an inline color CRT in accordance with the principles of the present invention.

Referring to FIG. 1, there is shown a perspective view of a dynamic quadrupole lens 20 for use in an inline electron gun in a color CRT in accordance with the present invention. The manner in which the dynamic quadrupole lens of the present invention may be integrated into various existing electron gun arrangements is illustrated in FIGS. 13*a* and 13*b* through 16*a* and 16*b*, and is described in detail below. Various alternative embodiments of the dynamic quadupole lens of the present invention are illustrated in FIGS. 10 through 16 and are discussed below. Details of the embodiment of the dynamic quadrupole lens 20 illustrated in FIG. 1 are discussed in the following paragraphs, with the principles of the present invention covered in this discussion applicable to each of the various embodiments illustrated in FIGS. 6 through 12. The present invention may be used to correct for astigmatism in both Combined Optimum Tube and Yoke (COTY) CRTs and non-COTY CRTs as described below. A COTY-type main lens is used in an inline electron gun and allows the three electron guns to have a larger vertical lens while sharing the horizontal open space in the main lens for improved spot size.

The dynamic quadrupole lens 20 includes first, second and third electrodes 28, 30 and 32 arranged in mutual alignment. The first electrode 28 includes an elongated aperture 28*a* extending a substantial portion of the length of the electrode. Disposed along the length of the aperture 28*a* in a spaced manner are three enlarged portions of the aperture.

The second electrode 30 includes three keyhole-shaped apertures 30*a*, 30*b* and 30*c* arranged in a spaced manner along the length of the electrode. As in the case of the first electrode 28, the third electrode 32 includes an elongated aperture 32*a* extending along a substantial portion of the length thereof and including three spaced enlarged portions. Each of the aforementioned keyhole-shaped apertures 30*a*, 30*b* and 30*c* has a longitudinal axis which is aligned generally vertically as shown in FIG. 1, or generally transverse to the longitudinal axes of the apertures in the first and third electrodes 28 and 32. With the first, second and third electrodes 28, 30 and 32 arranged generally parallel and in linear alignment, the respective apertures of the electrodes are adapted to allow the transit of three electron beams 22, 24 and 26, each shown in the figure as a dashed line.

The second electrode 30 is coupled to a constant voltage source 34 and is charged to a fixed potential $VF_1$. The first and third electrodes 28, 32 are coupled to a variable voltage source 36 for applying a dynamic voltage $VF_2$ to these electrodes. The terms "voltage" and "potential" are used interchangeably in the following discussion. The present invention is described in detail in the following paragraphs with the dynamic and static voltages applied as indicated, although the principles of this invention also encompass applying a dynamic voltage to the second intermediate electrode 30 while maintaining the first and third electrodes 28, 32 at a fixed voltage.

Figure 2:
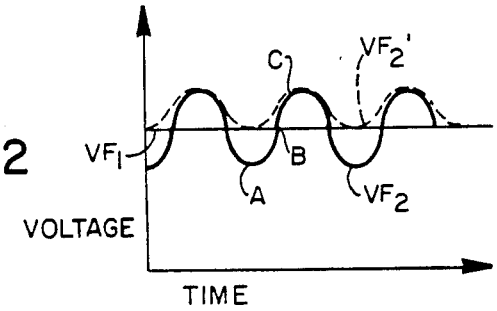
FIG. 2 is a graphic representation of the variation over time of the dynamic voltage applied to the quadrupole lens of the present invention.
Figure 3:
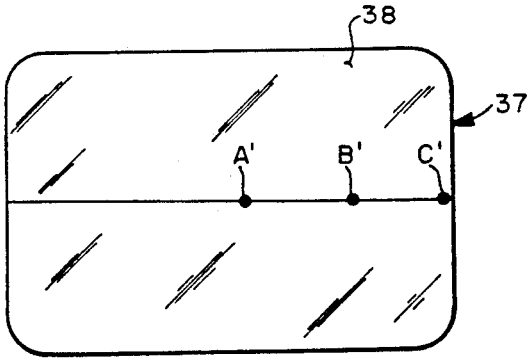
FIG. 3 is a simplified planar view of a phosphor screen on the inner surface of a CRT glass faceplate illustrating various deflection positions of the electron beams thereon.

Referring to FIG. 2, there is shown a graphic representation of the relative voltages at which the second electrode 30 and the first and third electrodes 28, 32 are maintained over time. As shown in FIG. 2, the $FV_1$ voltage is maintained at a constant value, while the $VF_2$ voltage varies in a periodic manner with electron beam sweep. The manner in which the $VF_2$ dynamic voltage varies with electron beam sweep can be explained with reference to FIG. 3 which is a simplified planar view of a CRT faceplate 37 having a phosphorescing screen 38 on the inner surface thereof. The dynamic focusing voltage $VF_2$ applied to the first and third electrodes 28, 32 varies in a periodic manner between a minimum value at point A and a maximum value at point C as shown in FIG. 2. The minimum value at point A corresponds to the electron beams positioned along a vertical centerline of the CRT screen 38 such as shown at point A' as the electron beams are deflected horizontally across the screen. As the electron beams are further deflected toward the right in FIG. 3 in the vicinity of point B, the dynamic voltage $VF_2$ increases to the value of the fixed focus voltage $VF_1$ as shown at point B in FIG. 2. Further deflection of the electron beams toward the right edge of the CRT screen 38 at point C' occurs as the dynamic focus voltage $VF_2$ increases to its maximum value at point C in FIG. 3 which is greater than $VF_1$. The dynamic voltage $VF_2$ then decreases to the value of the fixed focus voltage $VF_1$ as the electron beamsare deflected leftward in FIG. 3 toward point B' which is intermediate the center and lateral edge locations on the CRT screen 38. The dynamic voltage $VF_2$ varies relative to the fixed voltage $VF_1$ in a similar manner when the electron beams are deflected to the left of point A' in FIG. 3 to cover the other half of the CRT screen. In some color CRTs currently in use, such as those of the COTY type, the dynamic focus voltage is varied in a periodic manner but does not go below the fixed focus voltage $VF_1$. This type of dynamic focus voltage is labeled $VF_2'$ in FIG. 2 and is shown in dotted line form therein. The dynamic focus voltage is applied to the first and third electrodes 28, 32 synchronously with the deflection yoke current to change the quadrupole fields applied to the electron beam so as to either converge or diverge the electron beams, depending upon their position on the CRT screen, in correcting for deflection yoke-produced astigmatism and beam defocusing effects as described below.

Figure 4A:
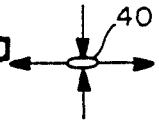
FIGS. 4*a* and 4*b* are sectional views of an electron beam respectively illustrating vertical convergence/-horizontal divergence (negative astigmatism correction) and vertical divergence/horizontal convergence (positive astigmatism correction) effected by the dynamic quadrupole lens of the present invention.
Figure 4B:
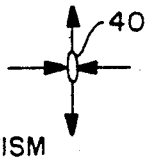

Referring to FIGS. 4*a* and 4*b*, there is shown the manner in which the spot of an electron beam 40 may be controlled by the electrostatic field of a quadrupole lens. The arrows in FIGS. 4*a* and 4*b* indicate the direction of the forces exerted upon an electron beam by the electrostatic field. In FIG. 4*a*, the quadrupole lens is horizontally diverging and vertically converging causing a negative astigmatism of the electron beam 40. This negative astigmatism corrects for the positive astigmatism of the beam introduced by a COTY-type main lens. Negative astigmatism correction is introduced when the beam is positioned in the vicinity of the vertical center of the CRT screen in a COTY-type main lens. In FIG. 4*b*, the quadrupole lens is vertically diverging and horizontally converging for introducing a positive astigmatism correction in the electron beam. Positive astigmatism correction compensates for the negative astigmatism of the electron beam spot caused by the self-converging magnetic deflection yoke as the electron beam is deflected adjacent to a lateral edge of the CRT's screen. Positive and negative astigmatism correction is applied to the electron beams in a COTY type of CRT. In a non-COTY type of CRT, only positive astigmatism is applied in the electron beams. The manner in which the present invention compensates for astigmatism in both types of CRTs is discussed in detail below.

Operation of the dynamic quadrupole lens 20 for an inline color CRT as shown in FIG. 1 will now be described with reference to Table I. Table I briefly summarizes the effect of the electrostatic field of the dynamic quadrupole lens 20 applied to an electron beam directed through the lens. The electrostatic force applied to the electrons in an electron beam by the electrostatic field of the dynamic quadrupole lens is shown in FIG. 5.

Figure 5:
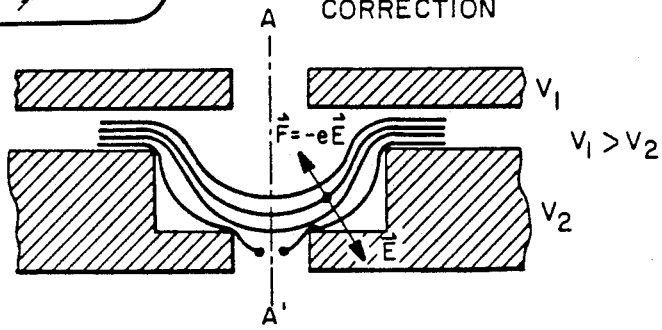
FIG. 5 is a simplified sectional view illustrating the electrostatic potential lines and electrostatic force applied to an electron in the space between two charged electrodes.

Referring to FIG. 5, there is shown a simplified illustration of the manner in which an electrostatic field, represented by the field vector $\vec{E}$, applies a force, represented by the force vector $\vec{F}$, to an electron. An electrostatic field is formed between two charged electrodes, with the upper electrode charged to a voltage of $V_1$ and the lower electrode charged to a voltage of $V_2$, where $V_1$ is greater than $V_2$. The electrostatic field vector $\vec{E}$ is directed toward the lower electrode, while the force vector $\vec{F}$ is directed toward the upper electrode because of the electron's negative charge. FIG. 5 provides a simplified illustration of the electrostatic force applied to an electron, or an electron beam, directed through apertures in adjacent charged electrodes which are maintained at different voltages. It can be seen that the relative width of the two apertures in the electrodes as well as the relative polarity of the two electrodes determines whether the electron beam is directed away from the A-A' axis (divergence), or toward the A-A' axis (convergence).

With reference to FIG. 1 in combination with Table I, the horizontal slots 28*a*, 32*a* in the first and third electrodes 28, 32 cause vertical divergence of the electron beam when they are maintained at a voltage greater than the second electrode 30 such as when the electron beams are positioned adjacent to a lateral edge of the CRT screen. With the second electrode 30 maintained at a lower voltage $VF_1$ than the other two electrodes when the electron beams are located adjacent the CRT screen's lateral edge, as shown at point C in FIG. 2, the vertically aligned apertures of the second electrode effect a horizontal convergence of the electron beams which reinforces the vertical divergence correction of the other two electrodes. This combination of vertical divergence and horizontal convergence of an electron beam 40 is shown in FIG. 4*b* and represents a positive astigmatism correction which compensates for the negative astigmatism introduced in the electron beam by the CRT's self-converging magnetic deflection yoke.

When the electron beams are positioned between the center and a lateral edge of the CRT screen, all three electrodes are at the same voltage and the dynamic quadrupole lens does not introduce either an astigmatism or a focus correction factor in the electron beams. In non-COTY CRTs, the three electrodes are also maintained at the same voltage when the electron beams are positioned on a vertical center portion of the CRT screen as shown graphically in FIG. 2 for the dynamic focus voltage $VF_2'$. In this case, because all three electrodes are again maintained at the same voltage, the dynamic quadrupole lens does not introduce a correction factor in the electron beams to compensate for deflection yoke astigmatism and defocusing effects. In COTY-type CRTs, the dynamic focusing voltage $VF_2$ applied to the first and third electrodes 28, 30 is less than the fixed voltage $VF_1$ of the second electrode 30 in the vicinity of the center of the CRT screen. With the polarity of the electrodes changed, the first and third electrodes 28, 32 introduce a vertical convergence in the electron beams as shown in Table I. The second electrode 30, now at a higher voltage than the other two electrodes, introduces a horizontal divergence by virtue of its generally vertically aligned apertures. The vertical convergence effected by the first and third electrodes 28, 32 and the horizontal divergence caused by the second electrode 30 introduces a negative astigmatism correction in the electron beams as shown in FIG. 4*a*. The negative astigmatism correction compensates for the positive astigmatism effects of a COTY-type electron gun on the electron beams in the center of the CRT screen.

Although the first and third electrodes 28, 32 are each shown with a single elongated, generally horizontally aligned aperture, the present invention also contemplates providing each of these electrodes with a plurality of spaced, aligned apertures each having a horizontally oriented longitudinal axis and adapted to pass a respective one of the electron beams. In addition, while the operation of the present invention has thus far been described with the dynamic quadrupole lens positioned after electron beam cross over, or between cross over and the CRT screen, the dymnamic quadrupole lens may also be positioned before beam cross over, or between the electron beam source and cross over. The effect of the dynamic quadrupole lens on the electron beams is reversed in these two arrangements as shown in Table I.

TABLE I

| SLOT LOCATION | MAJOR AXIS OF SLOT | FORCE DIRECTION ON THE E-BEAM | OPTICAL EFFECT ON THE E-BEAM AFTER CROSS OVER | COMMENTS |
|---|---|---|---|---|
| HIGHER VOLTAGE SIDE | VERTICAL (Y-DIRECTION) | X-AWAY FROM AXIS Y-NO EFFECT | HORIZ. DIV. | (A) FIELD VECTOR "E" IS IN DIRECTION FROM HIGH VOLTAGE SIDE TO LOW VOLTAGE SIDE (EQUIPOTENTIAL LINES) |
| | HORIZ. (X-DIRECTION) | X-NO EFFECT Y-AWAY FROM AXIS | VERT. DIV. | |
| LOWER VOLTAGE SIDE | VERT. (Y-DIRECTION) | X-TOWARD AXIS Y-NO EFFECT | HORIZ. CONV. | (B) FORCE VECTOR "F" ON ELECTRON IS EQUAL TO -e E |
| | HORIZ. (X-DIRECTION) | X-NO EFFECT Y-TOWARD AXIS | VERT. CONV. | |

Referring to FIGS. 6 through 12, there are shown various alternative embodiments of the dynamic quadrupole lens of the present invention. In the dynamic quadrupole lens 50 of FIG. 6, the first and third electrodes 51 and 53 include respective elongated, generally rectangular apertures 51*a* and 53*a* through which the three electron beams are directed. The second electrode 52 includes a plurality of spaced, generally rectangular shaped apertures 52*a*, 52*b* and 52*c*. Each of the rectangular apertures 52*a*, 52*b* and 52*c* is aligned lengthwise in a generally vertical direction.

Figure 6:
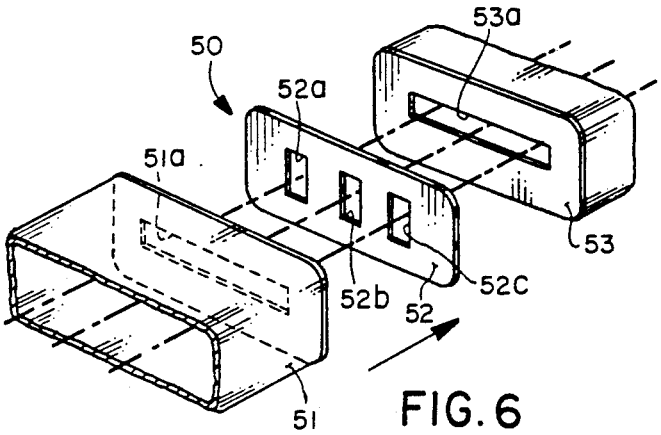
FIGS. 6 through 12 illustrate additional embodiments of a dynamic quadrupole lens for focusing a plurality of electron beams in an inline color CRT in accordance with the principles of the present invention.
Figure 8:
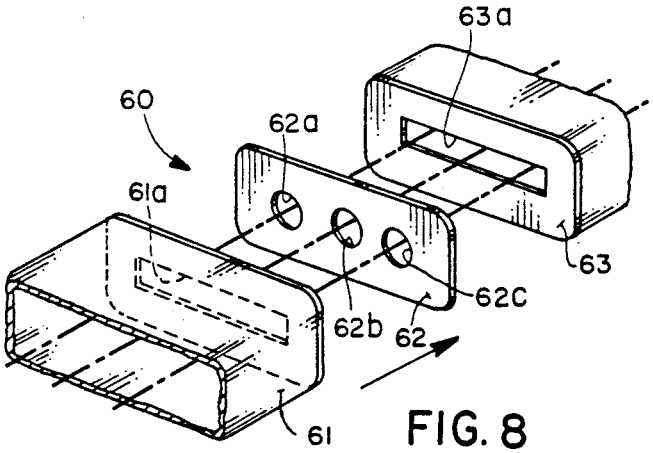

The dynamic quadrupole lens 60 of FIG. 8 is similar to that of FIG. 6 in that the first and third electrodes 61 and 63 each include a respective rectangular, horizontally oriented aperture 61*a* and 63*a*. However, in the dynamic quadrupole lens 60 of FIG. 8, the second electrode 62 includes three circular pertures 62*a*, 62*b* and 62*c*. Where circular apertures are employed, the second electrode 62 will not function as a quadrupole lens element, although the first and third electrodes 61 and 63 will continue to so operate. The three apertures 62*a*, 62*b* and 62*c* may also be elliptically shaped with their major axes oriented generally vertically, in which case the second electrode 62 will function as a quadrupole lens element to converge or diverge the electron beams, as the case may be.

Figure 7:
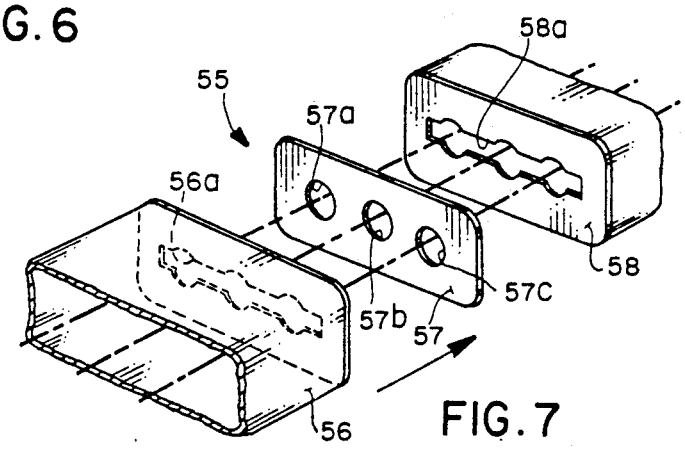
Figure 9:
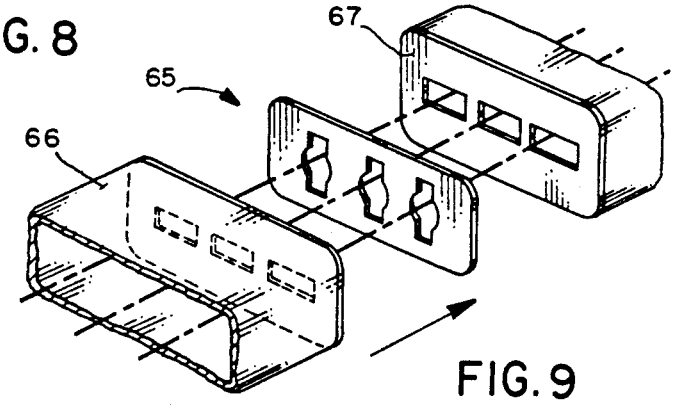
Figure 10:
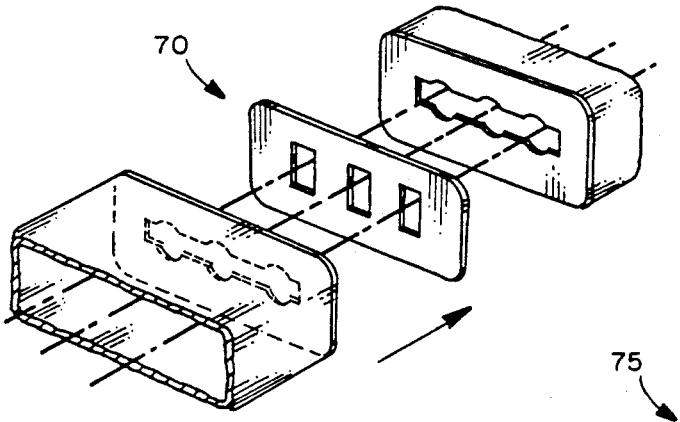

The dynamic quadrupole lens 55 of FIG. 7 is a combination of the lenses shown in FIGS. 1 and 8 in that the second electrode 57 includes three circular, or elliptically shaped, apertures 57*a*, 57*b* and 57*c*, while the first and third electrodes 56 and 58 each include respective elongated, horizontally oriented apertures 56*a* and 58*a*. Each of the apertures 56*a* and 58*a* includes aplurality of spaced enlarged portions through which a respective one of the electron beams is directed. The dynamic quadrupole lenses 65 and 70 respectively shown in FIGS. 9 and 10 also include three spaced electrodes in alignment with three electron beams, wherein the electrodes include various combinations of apertures previously described and illustrated. In FIG. 9, the first and third electrodes 66 and 67 are each shown with a plurality of spaced elongated apertures having their longitudinal axes in common alignment with the inline electron beams.

Figure 11:
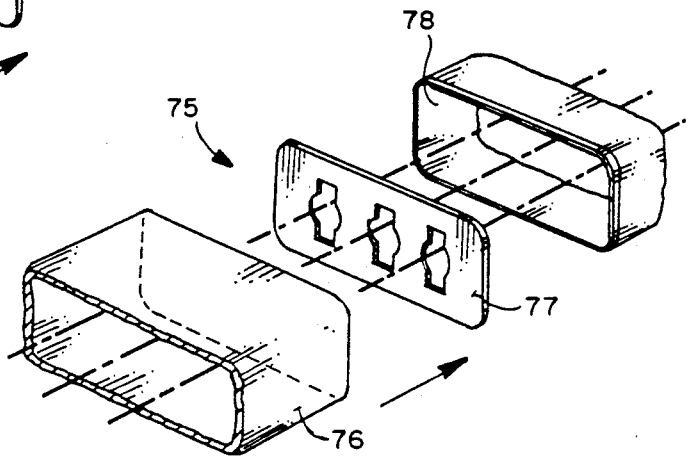
Figure 12:
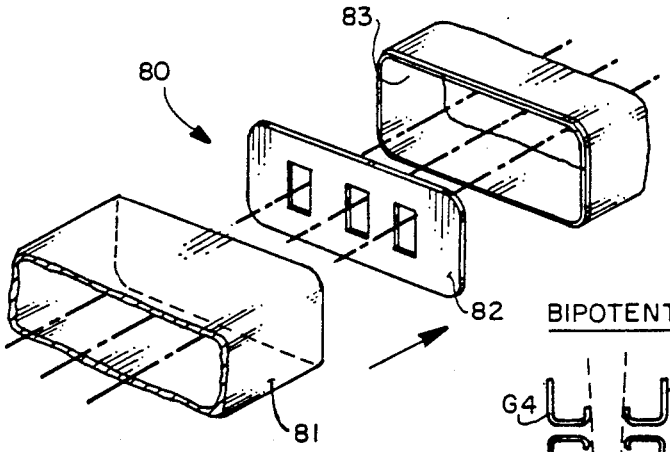

Referring to FIG. 11, there is shown yet another embodiment of a dynamic quadrupole lens 75 in accordance with the principles of the present invention. The dynamic quadrupole lens 75 includes first and third electrodes 76 and 78, which are each in the general form of an open frame through which the electron beams pass, and a second electrode 77 having three spaced, generally vertically oriented apertures through each of which a respective one of the electron beams is directed. The first and third electrodes 76 and 78 do not include an aperture through which electron beams are directed, or may be considered to have an infinitely large aperture disposed within a charged electrode. At any rate, it has been found that it is the dynamic focusing voltage applied to the first and third electrodes 76 and 78 which functions in combination with the charge on the second electrode 77, and the apertures therein, to provide electron beam convergence/divergence control in compensating for electron beam astigmatism and defocusing. The dynamic quadrupole lens 80 of FIG. 12 is similar to that shown in FIG. 11, except that the three apertures in the second electrode 82 are generally rectangular in shape and operate in conjunction with the first and third dynamically charged electrodes 81 and 83.

The dynamic quadrupole lens 75 operates in the following manner. In a COTY-type CRT, the second electrode 77 will be at a higher voltage than the first and third electrodes 76, 78 when the electron beams are positioned near the center of the CRT screen. The second electrode 77 will thus cause a horizontal divergence resulting in a negative astigmatism correction as shown in FIG. 4*a*. The first and third electrodes 76, 78 cause a vertical convergence of the electron beams to further effect negative astigmatism correction. When the electron beams are adjacent to a lateral edge of the CRT screen, the second electrode 77 will be at a lower voltage than the first and third electrodes 76, 78 resulting in horizontal convergence and vertical divergence of the electron beams as shown in Table I and as illustrated in FIG. 4*b* as a positive astigmatism correction. Thus, electron beam astigmatism and defocusing are corrected for by the dynamic quadrupole lenses of FIGS. 11 and 12, although the compensating effects of this electrode arrangement are not as great as in the previously discussed embodiments wherein all three electrodes are provided with apertures.

Figure 13A:
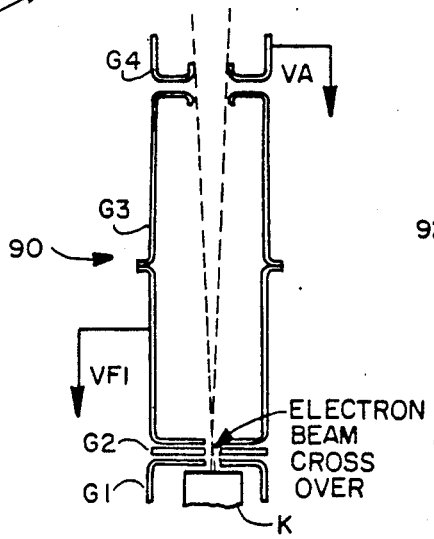
FIGS. 13*a* and 13*b* respectively illustrate sectional views of a prior art bipotential type ML electron focusing lens and the manner in which the dynamic quadrupole lens of the present invention may be incorporated in such a prior art electron beam focusing lens.

Referring to FIG. 13*a*, there is shown a conventional bipotential type main lens (ML) electron gun 90. The bipotential type ML electron gun 90 includes a cathode K which provides electrons to the combination of a control grid electrode G1, a screen grid electrode G2, a first accelerating and focusing electrode G3, and a second accelerating and focusing electrode G4. A focusing voltage $VF_1$ is applied to the first accelerating and focusing electrode G3, and an accelerating voltage $V_A$ as applied to the second accelerating and focusing electrode G4.

Figure 13B:
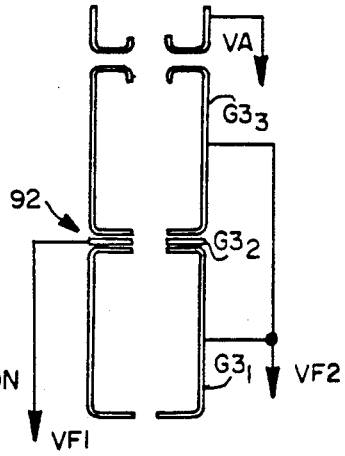

FIG. 13*b* shows the manner in which a dynamic quadrupole lens 92 may be incorporated in a conventional bipotential type ML electron gun. The dynamic quadrupole lens 92 includes adjacent plates of a $G3_1$ electrode and a $G3_3$ electrode to which a dynamic focusing voltage VF2 is applied. The dynamic quadrupole lens 92 further includes a $G3_2$ electrode, or grid, which is maintained at a fixed voltage VF1. The cathode as well as various other control grids which are illustrated in FIG. 13*a* have been omitted from FIG. 13*b*, as well as the remaining figures, for simplicity. Thus, a bipotential type ML electron gun may be converted to an electron gun employing the dynamic quadrupole lens of the present invention by separating its first accelerating and focusing electrode G3 into two components and inserting a third fixed voltage electrode $G3_2$ between the two accelerating and focusing electrode components $G3_3$ and $G3_1$.

Figure 14A:
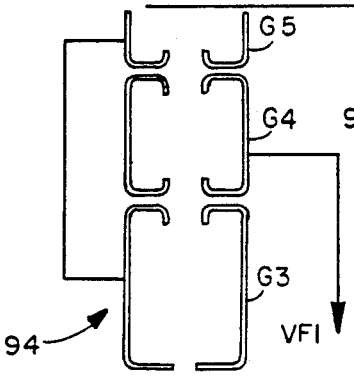
FIGS. 14*a* and 14*b* are sectional views of a prior art Einzel-type ML electron focusing lens and the same focusing lens design incorporating a dynamic quadrupole lens in accordance with the present invention, respectively.

Referring to FIG. 14*a*, there is shown a conventional Einzel-type ML electron gun 94 which includes G3, G4 and G5 accelerating and focusing electrodes. The G4 electrode is maintained at a fixed focusing voltage VF1, while a dynamic focusing voltage is applied to the G3 and G5 electrodes.

Figure 14B:
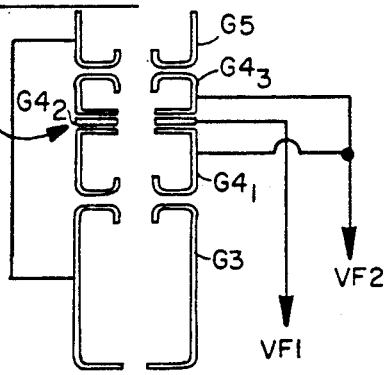

Referring to FIG. 14*b*, there is shown the manner in which a dynamic quadrupole lens 96 in accordance with the present invention may be incorporated in a conventional Einzel-type ML electron gun. In the electron gun arrangement of FIG. 14*b*, the G4 electrode is divided into two lens components $G4_1$ and $G4_3$, and a third focusing electrode $G4_2$ is inserted between the adjacent charged plates of the $G4_1$ and $G4_3$ electrodes. A fixed focus voltage VF1 is applied to the $G4_2$ electrode, while a dynamic focus voltage VF2 is applied to the $G4_1$ and $G4_3$ electrodes. The dynamic quadrupole lens 96 within the Einzel-type ML electron gun thus includes adjacent charged plates of the $G4_1$ and $G4_3$ accelerating and focusing electrodes in combination with an intermediate $G4_2$ electrode which is maintained at a fixed focus voltage VF1.

Figure 15A:
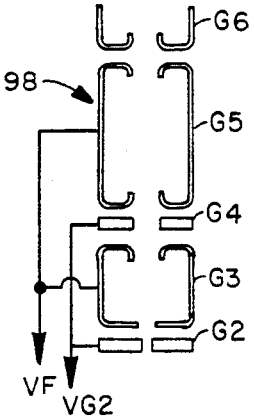
FIGS. 15*a*, 15*b*, 15*c* and 15*d* respectively illustrate sectional views of a prior art QPF-type ML electron focusing lens and three versions of such a QPF-type ML lens incorporating a dynamic quadrupole lens in accordance with the present invention.

Referring to FIG. 15*a*, there is shown a conventional QPF type ML electron gun 98. The QPF type ML electron gun 98 includes G2, G3, G4, G5 and G6 electrodes. A fixed focus voltage VF is applied to the G3 and G5 electrodes.

Figure 15B:
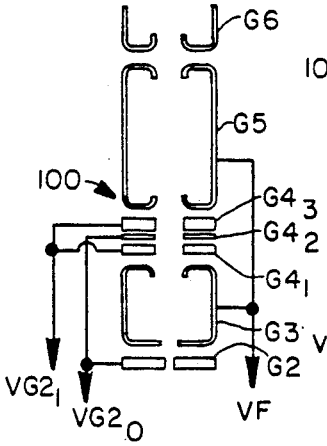

FIG. 15*b* illustrates the manner in which a dynamic quadrupole lens 100 in accordance with the present invention may be incorporated in the G4 electrode of a QPF type ML electron gun. In the arrangement of FIG. 15*b*, the G4 electrode is comprised of $G4_1$, $G4_2$ and $G4_3$ electrodes. The G2 and $G4_2$ electrodes are maintained at a voltage $VG2_0$, while the $G4_1$ and $G4_3$ electrodes are maintained at a voltage $VG2_1$. The $VG2_0$ voltage is fixed, while the $VG2_1$ voltage varies synchronously with electron beam sweep across the CRT screen.

Figure 15C:
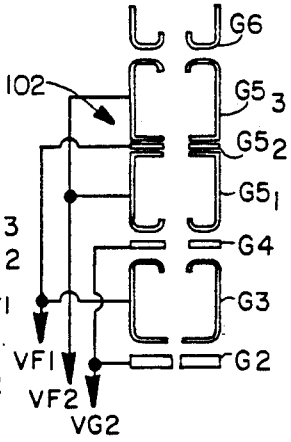
Figure 15D:
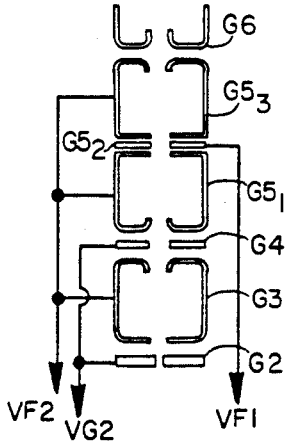

Referring to FIG. 15*c*, there is shown the manner in which a dynamic quadrupole lens 102 in accordance with the present invention may be incorporated in the G5 electrode of a conventional QPF type ML electron gun. In the arrangement of FIG. 15*c*, the G5 accelerating and focusing electrode of a conventional QPF type ML electron gun has been divided into three control electrodes $G5_1$, $G5_2$ and $G5_3$. A fixed focus voltage VF1 is applied to the G3 and $G5_2$ electrodes, while a dynamic focus voltage VF2 is applied to the $G5_1$ and $G5_3$ electrodes. A VG2 voltage is applied to the G2 and G4 electrodes. The dynamic quadrupole lens 102 is comprised of the $G5_2$ electrode in combination with the adjacent plates of the $G5_1$ and $G5_3$ electrodes. In FIG. 15*d*, the G3 electrode is shown coupled to the VF2 focus voltage rather than the VF1 focus voltage as in FIG. 15*c*. In the arrangement of FIG. 15*d*, two spatially separated quadrupoles each apply an astigmatism correction to the electron beams. A first qudrupole is comprised of the upper plate of the G3 electrode, the lower plate of the $G5_1$ electrode, and the G4 electrode disposed therebetween. A dynamic focus voltage VF2 is provided to the G3, $G5_1$ and $G5_3$ electrodes. The second quadrupole is comprised of the upper plate of the $G5_1$ electrode, the lower plate of the $G5_3$ electrode, and the $G5_2$ electrode disposed therebetween. The $G5_3$ and G6 electrodes form an electron beam focusing region, while the combination of electrodes G2 and G3 provide a convergence correction for the two outer electron beams as the beams are swept across the CRT screen with changes in the electron beam focus voltage. This is commonly referred to as a FRAT (focus refraction alignment test) lens.

Referring to FIG. 16, there is shown a conventional BU type ML electron gun 104. The BU type ML electron gun 104 includes G3, G4, G5 and G6 electrodes. An anode voltage VA is applied to the G4 and G6 electrodes, while a dynamic focus voltage VF is applied to the G3 and G5 electrodes.

Figure 16A:
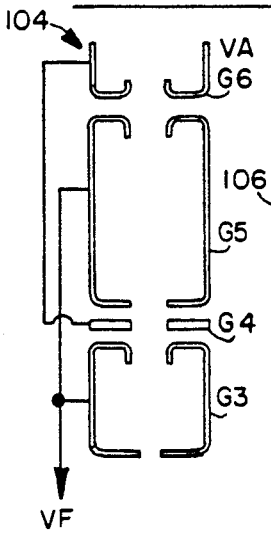
FIGS. 16*a* and 16*b* respectively illustrate sectional views of a prior BU-type ML electron focusing lens and the same type of electron focusing lens incorporating the inventive dynamic quadrupole lens of the present invention.
Figure 16B:
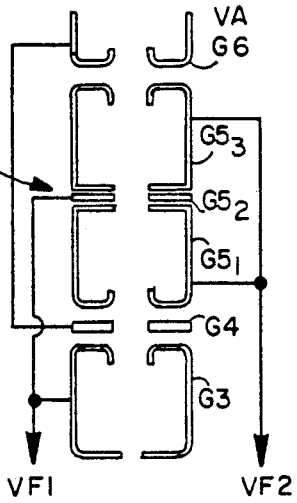

FIG. 16*b* shows the manner in which a dynamic quadrupole lens 106 in accordance with the present invention may be incorporated in a conventional BU type ML electron gun. The G5 electrode of the prior art BU type ML electron gun is reduced to two electrodes $G5_1$ and $G5_3$, with a third electrode $G5_2$ inserted therebetween. The dynamic quadrupole lens 106 thus is comprised of adjacent plates of the $G5_1$ and $G5_3$ electrodes in combination with the $G5_2$ electrode. A fixed focus voltage VF1 is applied to the G3 and $G5_2$ electrodes, while the anode voltage VA is applied to the G4 and G6 electrodes. A dynamic focusing voltage $VF_2$ is applied to the $G5_1$ and $G5_3$ electrodes in the electron gun.

There has thus been shown a dynamic quadrupole lens which may be easily incorporated in any of the more conventional color CRT electron guns and which provides astigmatism and defocusing compensation for the CRT's electron beams. The dynamic quadrupole lens includes three charged electrodes, with a dynamic focus voltage $VF_2$ applied to the two outer electrodes and a fixed focus voltage $VF_1$ applied to the intermediate electrode. The electrodes, which are preferably in the form of flat plates, are provided with various combinations of elongated apertures through which the electron beams transit, with the longitudinal axis of the apertures selected to provide the desired beam divergence/convergence correction to minimize astigmatism and improve beam focusing.

While particular embodiments of the present invention have been shown and described, it will be obvious to those skilled in the art that changes and modifications may be made without departing from the invention in its broader aspects. For example, while the present invention has been described as applying a dynamic voltage to first and third electrodes and a fixed voltage to a second electrode spaced therebetween, this invention also contemplates applying a dynamic voltage to the second electrode while maintaining the spaced first and third electrodes at a fixed voltage. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use in focusing a plurality of electron beams on a screen of a color cathode ray tube, wherein said electron beams are aligned in an in-line array and are deflected across said screen by an asymmetric magnetic field which causes astigmatism of said electron beams, an electron gun comprising:

first and third electrodes each adapted to receive a common dynamic voltage and each having for each beam a keyhole-shaped, horizontally oriented opening through which the electron beam passes;

a second electrode between said first and third electrodes adapted to receive a fixed voltage and having for each beam a vertically oriented, keyhole-shaped aperture, said first, second and third electrodes, when excited, establishing dynamic quadrupole fields effective to compensate the electron beams for said beam astigmatism.

2. For use in focusing a plurality of electron beams on a screen of a color cathode ray tube, wherein said electron beams are aligned in an in-line array and are deflected across said screen by an asymmetric magnetic field which causes astigmatism of said electron beams, an electron gun comprising:

first and third electrodes each adapted to receive a common dynamic voltage and each having for each beam a keyhole-shaped, horizontally oriented opening through which the electron beam passes;

a second electrode between said first and third electrodes adapted to receive a fixed voltage and having for each beam a circular aperture, said first, second and third electrodes, when excited, establishing dynamic quadrupole fields effective to compensate the electron beams for said beam astigmatism.

3. For use in focusing a plurality of electron beams on a screen of a color cathode ray tube, wherein said electron beams are aligned in an in-line array and are deflected across said screen by an asymmetric magnetic field which causes astigmatism of said electron beams, an electron gun comprising:

first and third electrodes each adapted to receive a common dynamic voltage and having a horizontally elongated slot through which the electron beams pass;

a second electrode between said first and third electrodes adapted to receive a fixed voltage and having for each beam a circular aperture, said first, second and third electrodes, when excited, establishing dynamic quadrupole fields to the electron beams effective to compensate for said beam astigmatism.

* * * * *